US008456265B2

(12) United States Patent
Fornage et al.

(10) Patent No.: US 8,456,265 B2
(45) Date of Patent: Jun. 4, 2013

(54) TRANSFORMER

(75) Inventors: Martin Fornage, Petaluma, CA (US); Donald Richard Zimmanck, Petaluma, CA (US)

(73) Assignee: Enphase Energy, Inc., Petaluma, CA (US)

( * ) Notice: Subject to any disclaimer, the term of this patent is extended or adjusted under 35 U.S.C. 154(b) by 0 days.

(21) Appl. No.: 13/086,115

(22) Filed: Apr. 13, 2011

(65) Prior Publication Data

US 2011/0260824 A1 Oct. 27, 2011

Related U.S. Application Data

(60) Provisional application No. 61/342,371, filed on Apr. 13, 2010.

(51) Int. Cl.

| | |
|---|---|
| ***H01F 38/20*** | (2006.01) |
| ***H01F 27/28*** | (2006.01) |
| ***H01F 17/06*** | (2006.01) |
| ***H01F 27/30*** | (2006.01) |
| ***H01F 17/04*** | (2006.01) |

(52) U.S. Cl.
USPC ..... 336/173; 336/170; 336/178; 336/198; 336/220; 336/221

(58) Field of Classification Search
USPC ..... 336/220–222, 198, 208, 145, 178, 336/182, 170, 173, 212, 192; 29/606, 602.1, 29/607
See application file for complete search history.

(56) References Cited

U.S. PATENT DOCUMENTS

| | | | | |
|---|---|---|---|---|
| 4,999,743 | A * | 3/1991 | Fontana et al. | 361/782 |
| 5,068,776 | A | 11/1991 | Polivka | |
| 5,315,498 | A | 5/1994 | Berrios et al. | |
| 5,631,822 | A * | 5/1997 | Silberkleit et al. | 363/144 |
| 6,320,490 | B1 * | 11/2001 | Clayton | 336/180 |
| 7,446,642 | B2 * | 11/2008 | Fang et al. | 336/212 |
| 2004/0222874 | A1 * | 11/2004 | Suzui | 336/198 |
| 2007/0115700 | A1 | 5/2007 | Springett | |
| 2009/0315661 | A1 * | 12/2009 | Teng et al. | 336/192 |

OTHER PUBLICATIONS

International Search Report and Written Opinion mailed Dec. 15, 2011 for PCT Application No. PCT/US2011/032298.

* cited by examiner

*Primary Examiner* — Elvin G Enad
*Assistant Examiner* — Mangtin Lian
(74) *Attorney, Agent, or Firm* — Moser Taboada

(57) ABSTRACT

A transformer assembly. In some embodiments, the transformer assembly comprises a transformer, comprising a magnetic core; a primary winding wound around the magnetic core, wherein the primary winding comprises one or two turns of a first conductive material; and a secondary winding wound around the magnetic core, wherein the secondary winding comprises a plurality of turns of a second conductive material, and wherein a diameter of the magnetic core is sized such that the transformer achieves a first inductance with a core loss comparable to a winding loss.

14 Claims, 8 Drawing Sheets

TRANSFORMER

CROSS-REFERENCE TO RELATED APPLICATIONS

This application claims benefit of U.S. provisional patent application Ser. No. 61/342,371, filed Apr. 13, 2010, which is herein incorporated in its entirety by reference.

BACKGROUND OF THE INVENTION

1. Field of the Invention

Embodiments of the present disclosure relate generally to transformers and, more particularly, to a low profile, high frequency, high efficiency transformer.

2. Description of the Related Art

Transformers are used in a variety of devices to perform functions such as altering a voltage level (e.g., converting a mains voltage to low voltage for powering electronics), circuit isolation, measuring voltage or current in electrical power systems, and a host of other functions. Often, transformers will sandwich a primary winding between two secondary windings to reduce leakage inductance. In order to provide sufficient space for the windings, the winding area of a transformer is generally large as compared to a cross-sectional area of the transformer's core, resulting in a large form-factor as well as high magnetic losses. Additionally, the large number of windings results in high copper losses.

Traditionally, magnetic vendors may try to optimize this form factor in order to maximize efficiency by allowing designs which have a good tradeoff between magnetic losses in the core material and copper losses in the winding. However, at high frequencies (e.g., hundreds of kilohertz) a design which uses the entire core window will have very large proximity effect losses.

Additionally, for devices or circuits employing current and/or voltage sensing transformers, space within the device or on the circuit board must be allocated to support the sensing transformer, thereby increasing the number of parts that need to be assembled as well as a number of connections that must be made.

Therefore, there is a need in the art for an improved transformer.

SUMMARY OF THE INVENTION

Embodiments of the present invention generally relate to a transformer assembly. In one embodiment, the transformer assembly comprises a transformer, comprising a magnetic core; a primary winding wound around the magnetic core, wherein the primary winding comprises one or two turns of a first conductive material; and a secondary winding wound around the magnetic core, wherein the secondary winding comprises a plurality of turns of a second conductive material, and wherein a diameter of the magnetic core is sized such that the transformer achieves a first inductance with a core loss comparable to a winding loss.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

DETAILED DESCRIPTION

Figure 1:
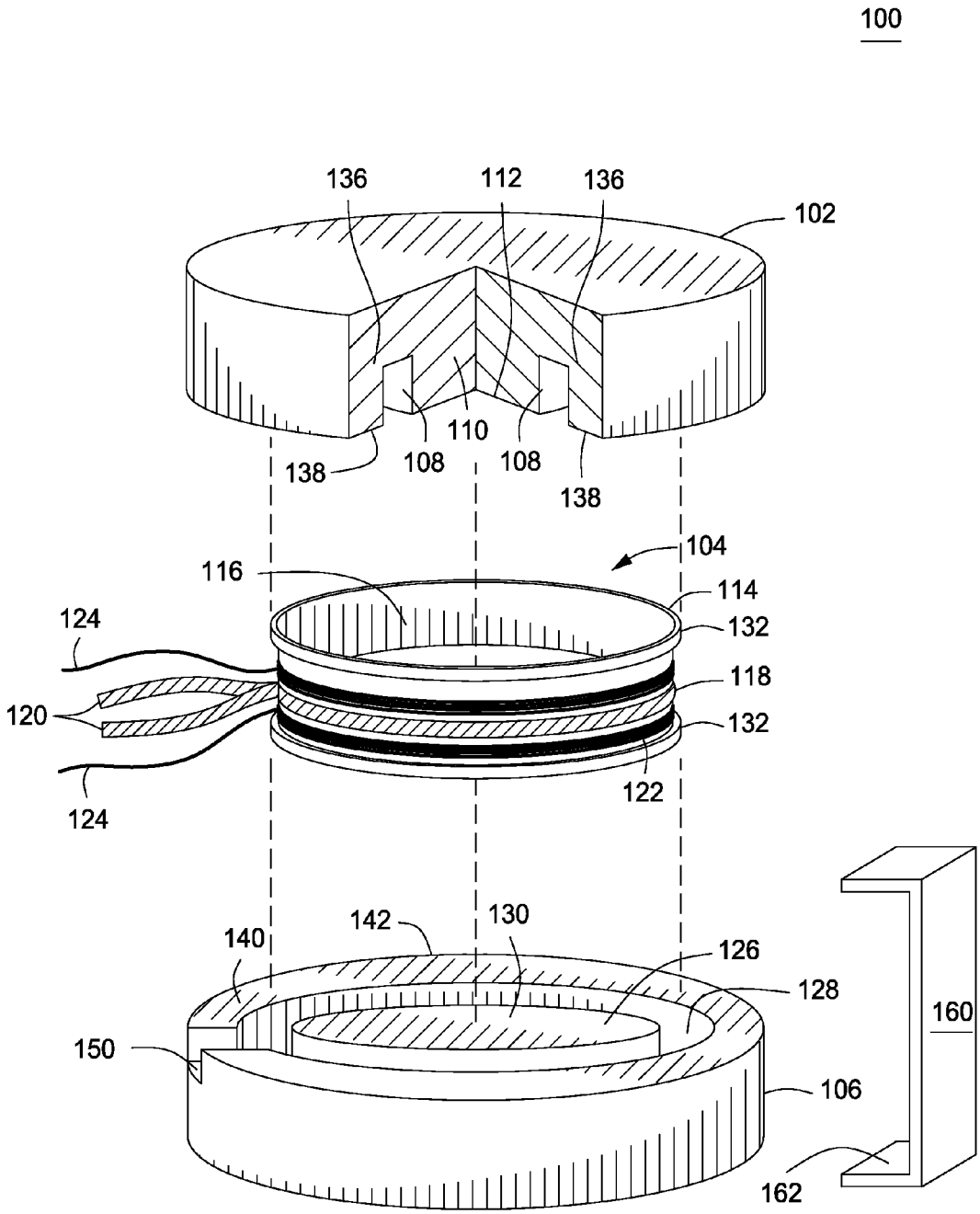
FIG. 1 is an exploded, perspective view of a transformer assembly in accordance with one or more embodiments of the present invention.

FIG. 1 is an exploded, perspective view of a transformer assembly 100 in accordance with one or more embodiments of the present invention. The transformer assembly 100 comprises a first pole piece 102, a bobbin winding assembly 104, and a second pole piece 106.

The first pole piece 102 is depicted as having been partially cut away in order to illustrate the configuration of the first pole piece 102. The first pole piece 102 is comprised of a magnetic material, such as ferrite, and defines an annular channel 108 sized so as to receive the bobbin winding assembly 104; i.e., the first pole piece 102 is a magnetic puck having an annular channel 108 formed in it. The channel 108 defines a post 110 (a first pole). The channel 108 is defined by an outer surface of the post 110 and an inner surface of an annular rim 136. The post 110 and the rim 136 terminate on the underside of the first pole piece 102 in a generally flat post mating surface 112 and a generally flat rim mating surface 138, respectively. Although depicted as cylindrical in shape, the first pole piece 102 may be of any shape comprising the aforementioned features.

The bobbin winding assembly 104 comprises an annular bobbin 114, a primary winding 118, and a secondary winding 122. The bobbin 114 is formed of a rigid insulating material, such as dielectric plastic or the like, and defines a bobbin opening 116 at the center of the bobbin 114 and extending through the length of the bobbin 114. The bobbin 114 comprises flanges 132 around the top and bottom perimeters of the bobbin 114, the flanges 132 extending radially away from the bobbin opening 116. The length of the bobbin 114 is sized such that the primary winding 118 and the secondary winding 122 are retained within a winding area in the channel 108 defined between the flanges 132.

The primary winding 118 and the secondary winding 122 are each formed of a conductive material wound around the bobbin 114. In some embodiments, the primary winding 118 consists of a single turn of a conductive foil, such as an insulated, laminated foil; and the secondary winding 122 consists of a plurality of turns of a conductive wire, such as seven turns of insulated copper wire. In other embodiments, the primary winding 118 consists of two turns of the conductive foil, for example, employed in an interleaved design, and the secondary winding 122 consists of fourteen turns of the insulated copper wire.

The primary winding 118 terminates in two primary winding leads 120, and the secondary winding 122 terminates in two secondary winding leads 124. In certain embodiments, the secondary winding 122 may be encapsulated within the bobbin structure; e.g., the bobbin 114 may be formed of plastic within which the secondary winding 122 is encapsulated while the secondary winding leads 124 extend from the plastic.

Analogous to the first pole piece 102, the second pole piece 106 is comprised of magnetic material, such as ferrite, and defines an annular channel 128 sized so as to receive the bobbin winding assembly 104; i.e., the second pole piece 106 is a magnetic puck having the annular channel 128 formed in it. The annular channel 128 defines a post 126 (a second pole). The channel 128 is defined by an outer surface of the post 126 and an inner surface of an annular rim 140. The rim 140 terminates in a generally flat rim mating surface 142 for mating with the rim mating surface 138 such that the bobbin winding assembly 104 is surrounded by the rims 136 and 140; additionally, the second pole piece 106 defines a suitably sized and shaped notch 150 through which the primary winding leads 120 and the secondary winding leads 124 may extend.

The post 126 terminates in a generally flat post mating surface 130 for mating with the post mating surface 112 through the bobbin opening 116 to form a core (i.e., core 202 as described below with respect to FIG. 2) of the transformer assembly 100. In some embodiments, the post mating surfaces 112 and 130 may mate flushly and be adhered together by an adhesive, such as epoxy, bonding, silicone adhesive, or the like. In other embodiments, the post mating surfaces 112 and 130 are recessed from the planes of the rim mating surfaces 138 and 142, respectively. In such embodiments, non-conductive foam (or a similar material) may be retained between the post mating surfaces 130 and 112 for maintaining a space between the posts 110 and 126 (i.e., an air gap within the transformer core). For example, during assembly of the transformer assembly 100, foam may be applied as a fluid between the post mating surfaces 130 and 112 and subsequently cure into a hard material for maintaining the air gap. In some alternative embodiments, the air gap may be formed without the use of any material between the post mating surfaces 130 and 112 (i.e., the mating surfaces 130 and 112 are spaced apart).

Although depicted as cylindrical in shape, the second pole piece 106 may be of any shape comprising the aforementioned features.

As is known in the art, the primary coil inductance of a transformer is proportional to the core area. In accordance with one or more embodiments of the present invention, the width of the posts 110 and 126 (i.e., the width of the transformer core) are sized such that a desired inductance may be efficiently achieved when the transformer assembly 100 comprises a single turn of the primary winding 118 or, alternatively, two turns of the primary winding 118. The transformer core width is selected such that the desired inductance is achieved with a core loss comparable to the winding loss; for example, the transformer core may have a diameter on the order of 20 millimeters (mm). Such a configuration results in a small winding area as compared to the core cross-section, e.g., the winding window area may be 20 square millimeters ($mm^2$) and the core cross-section area 300 $mm^2$. In some embodiments, an inductance of 3.6 microhenries is achieved for a primary winding 118 having one turn, a secondary winding 122 having seven turns, and a core cross-sectional area of 6 square centimeters ($cm^2$). The relatively large width of the core and the small number of windings result in the transformer assembly 100 exhibiting a lower profile as well as low magnetic and copper losses (e.g., low leakage inductance as well as low proximity effect losses resulting in improved losses in the windings, especially at higher frequencies such as hundreds of kilohertz). In one embodiment, the transformer assembly 100 is capable of processing 225 watts (W) at 99% efficiency (i.e., 2.25 W loss) with a profile less than 15 mm.

The first pole piece 102 may be secured to the second pole piece 106 by a U-shaped clip 160 comprising flanges 162 for retaining the first pole piece 102 mated to the second pole piece 106. Additionally or alternatively, the first pole piece 102 may be secured to the second pole piece 106 by one or more other mechanical means, such as screws, bolts, bonding adhesives, snap features, clips, or the like.

Figure 2:
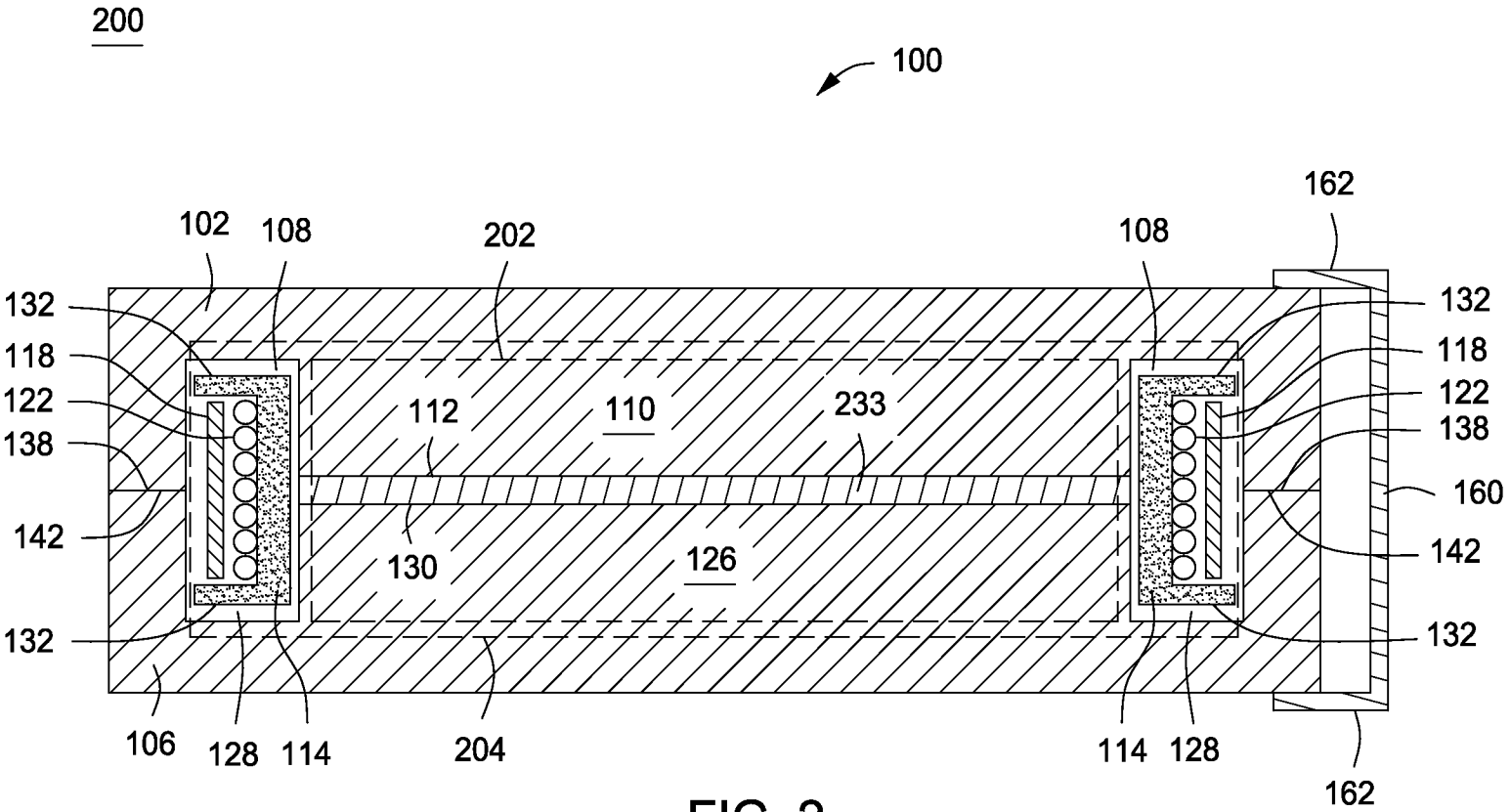
FIG. 2 is a cross-sectional view of the assembled transformer assembly in accordance with one or more embodiments of the present invention.

FIG. 2 is a cross-sectional view 200 of an assembled transformer assembly 100 in accordance with one or more embodiments of the present invention. The bobbin 114 is retained within the channels 108 and 128 of the first pole piece 102 and the second pole piece 106, respectively. The flanges 132 of the bobbin 114 define the winding area around the bobbin 114 within which the primary winding 118 and the secondary winding 122 are wound. As previously described with respect to FIG. 1, the primary winding 118 consists of a single turn of a conductive foil (or, alternatively, two turns of the conductive foil), and the secondary winding 122 consists seven turns of a conductive wire (such as a copper wire). In one or more alternative embodiments, the primary winding 118 and/or the secondary winding 122 may consist of fewer or more turns and/or may be formed from a different conductive material.

The rim mating surface 138 mates flushly with the rim mating surface 142. In some embodiments, the rim mating surface 138 may be adhered to the rim mating surface 142 by an adhesive, such as a silicone adhesive or a similar epoxy. In some embodiments, non-conductive foam 233 is retained between the post mating surfaces 112 and 130 for maintaining an air gap. In some alternative embodiments, an air gap between the post mating surfaces 112 and 130 may be maintained without the use of any material between the post mating surfaces 112 and 130. In other alternative embodiments, the post mating surfaces 112 and 130 may be mated flushly; in some such embodiments, the post mating surfaces 112 and 130 may be adhered to one another by a silicone adhesive or a similar epoxy.

The posts 110 and 126 form a core 202 and along with the primary winding 118 and the secondary winding 122 form a transformer 204 of the transformer assembly 100. As previously described with respect to FIG. 1, the core 202 is comprised of a magnetic material, such as ferrite (e.g., MnZNFe2O3, NiZnFe2O3, or the like) and exhibits a large cross-sectional area with respect to the winding area.

The clip 160 retains the first pole piece 102 and the second pole piece 106 for ensuring that the first pole piece 102 and the second pole piece 106 remain securely mated.

Figure 3:
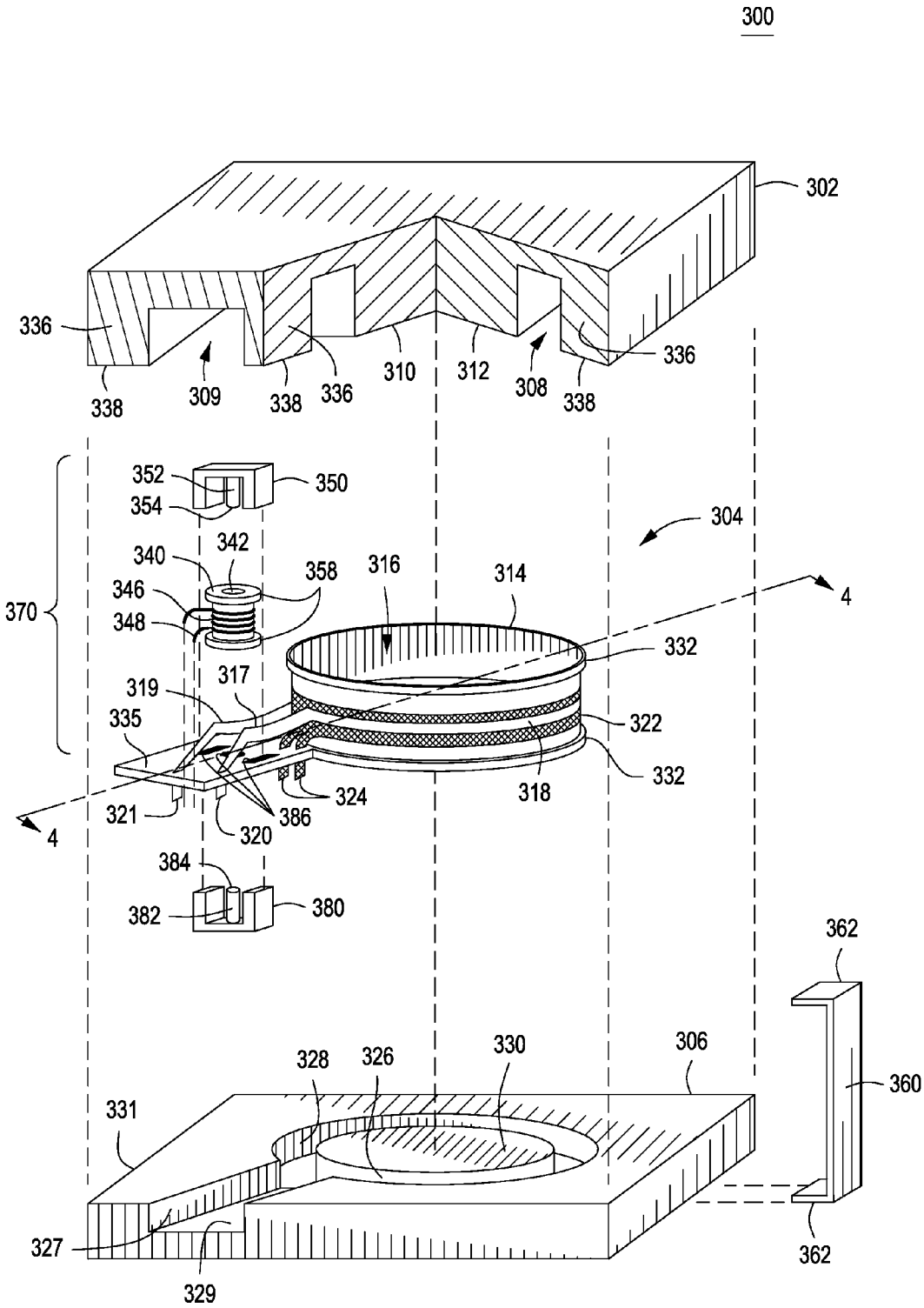
FIG. 3 is an exploded, perspective view of an integrated transformer assembly in accordance with one or more embodiments of the present invention.

FIG. 3 is an exploded, perspective view of an integrated transformer assembly 300 in accordance with one or more embodiments of the present invention. The transformer assembly 300 comprises a first pole piece 302, a bobbin winding assembly 304, a second pole piece 306, and a retaining clip 360.

The first pole piece 302 is depicted as having been partially cut away in order to illustrate the configuration of the first pole piece 302. The first pole piece 302 is comprised of a magnetic material, such as ferrite, and defines a channel 308 and a notch 309 sized so as to receive the bobbin winding assembly 304. The channel 308 is annular in shape and feeds into the notch 309. The notch 309 extends away from the channel 308 to an edge of the first pole piece 302 and is suitably sized and shaped such that a sense transformer winding assembly 370 of the bobbin winding assembly 304 may be retained external to the first pole piece 302, as further described below.

The first pole piece 302 comprises a cylindrical post 310 (a first pole) and a rim 336 such that the channel 308 is defined by an outer surface of the post 310 and an inner surface of the rim 336. The post 310 and the rim 336 terminate on the underside of the first pole piece 302 in a generally flat post mating surface 312 and a generally flat rim mating surface 338, respectively.

The bobbin winding assembly 304 comprises an annular bobbin 314, a primary winding 318, and a secondary winding 322. The bobbin 314 is formed of a rigid insulating material, such as dielectric plastic or the like, and defines a bobbin opening 316 at the center of the bobbin 314 and extending through the length of the bobbin 314. The bobbin 314 comprises flanges 332 around the top and bottom perimeters of the bobbin 314, the flanges 332 extending radially away from the bobbin opening 316. The length of the bobbin 314 is sized such that the primary winding 318 and the secondary winding 322 are retained within a winding area in the channel 308 defined between the flanges 332. In some embodiments, the bobbin 314 is of a size and shape corresponding to the bobbin 114, with the primary winding 318 consisting of a single turn of a conductive foil (e.g., an insulated, laminated foil) and the secondary winding 322 consisting of a plurality of turns of a conductive wire (e.g., seven turns of insulated copper wire); alternatively, the primary winding 318 may consist of two turns of the conductive foil, for example, employed in an interleaved design, and the secondary winding 322 consists of fourteen turns of insulated copper wire. In other embodiments, the primary winding 318 and/or the secondary winding 322 may consist of a different number of turns and/or may be formed from a different conductive material. In certain embodiments, the secondary winding 322 may be encapsulated within the bobbin structure; e.g., the bobbin 314 may be formed of plastic within which the secondary winding 322 is encapsulated while leads extend from the plastic.

The bobbin 314 further comprises a sense transformer base 335 extending perpendicularly away from the center of the bobbin 314. The sense transformer base 335 is suitably sized and shaped to support the sense transformer assembly 370. In some embodiments, the secondary winding 322 terminates in secondary winding leads 324 extending through the sense transformer base 335.

The sense transformer assembly 370 comprises an annular sense transformer bobbin 340, a first sense transformer frame member 350 ("frame member 350") and a second sense transformer frame member 380 ("frame member 380"). Analogous to the bobbin 314, the sense transformer bobbin 340 is formed of a rigid insulating material, such as dielectric plastic or the like, and defines a sense transformer bobbin opening 342 at the center of the sense transformer bobbin 340 and extending through the length of the sense transformer bobbin 340. The sense transformer bobbin 340 comprises flanges 358 around the top and bottom perimeters that extend away from the sense transformer bobbin opening 342.

The sense transformer bobbin 340 is wound by a sense transformer secondary winding 346 that terminates in sense transformer secondary winding leads 348 which generally extend through the sense transformer base 335. The sense transformer secondary winding 346 is formed of a conductive wire, such as copper wire, and in some embodiments consists of a number of turns on the order of one-hundred (e.g., 150 turns). In certain embodiments, the secondary winding 346 may be encapsulated within the sense transformer bobbin structure; e.g., the sense transformer bobbin 340 may be formed of plastic within which the secondary winding 348 is encapsulated while the sense transformer secondary winding leads 348 extend from the plastic.

First and second primary legs 317 and 319 extend from the primary winding 318 and each form a ½-turn winding around opposite sides of the sense transformer bobbin 340, thereby forming a single turn winding around the entire sense transformer bobbin 340. The primary legs 317 and 319 further extend through the sense transformer base 335 and terminate in primary winding leads 320 and 321, respectively. The length of the bobbin 314 is sized such that the primary legs 317 and 319 and the sense transformer secondary winding 346 are retained within a sense transformer winding area defined between the flanges 358.

The frame members 350 and 380 are generally E-shaped and formed of a magnetic material, such as ferrite (e.g., MnZNFe2O3, NiZnFe2-O3, or the like). In some embodiments, the frame member 350 comprises a cylindrical center post 352 (a first sense transformer pole) that mates with a cylindrical center post 382 (a second sense transformer pole) of the frame member 380 through the sense transformer bobbin opening 342 to form a core within the sense transformer assembly 370 (i.e., sense transformer core 404 as described below with respect to FIG. 4). Additionally, the sense transformer base 335 defines three cutouts 386, suitably sized and spaced such that the center posts 352 and 382 as well as the exterior legs of the frame members 350 and 380 may be mated through the cutouts 386. The exterior legs of the frame members 350 and 380 may be adhered to one another, for example, by an adhesive such as epoxy, bonding, silicone adhesive, or the like.

The center posts 352 and 382 may each terminate in generally flat mating surfaces 354 and 384, respectively, that are mated flushly to one another (i.e., without an air gap). The mating surfaces 354 and 384 may be adhered to one another, for example, by an adhesive such as epoxy, bonding, silicone adhesive, or the like. In some alternative embodiments, non-conductive foam or a similar material may be retained between the mating surfaces 354 and 384 to provide an air gap within the sense transformer core; in other alternative embodiments, an air gap may be maintained between the mating surfaces 354 and 384 without the use of any material (i.e., the mating surfaces 354 and 384 are spaced apart). The center posts 352/358 along with the primary legs 317/319 and the secondary winding 346 form a sense transformer (i.e., sense transformer 408 as described below with respect to FIG. 4).

Analogous to the first pole piece 302, the second pole piece 306 is comprised of magnetic material, such as ferrite, and defines a channel 328 and a notch 329 sized so as to receive the bobbin winding assembly 304. The channel 328 is annular in shape and feeds into the notch 329. The notch 329 extends away from the channel 328 to an edge of the second pole piece 306 and is suitably sized and shaped such that the sense transformer winding assembly 370 may be retained external to the mated first and second pole pieces 302/306, as further described below.

The second pole piece 306 comprises a cylindrical post 326 (a second pole) and a rim 327 such that the channel 328 is defined by an outer surface of the post 326 and an inner surface of the rim 327. The rim 327 terminates in a generally flat rim mating surface 331 for mating with the rim mating surface 338 of the first pole piece 302 such that a portion of the bobbin winding assembly 304 excluding the sense transformer assembly 370 is surrounded by the rims 336 and 327. The post 326 terminates in a generally flat post mating surface 330 for mating with the post mating surface 312 through the bobbin opening 316. The posts 310 and 326 form a power transformer core (i.e., core 402 as described below with respect to FIG. 4) through the bobbin opening 316, and, along with the primary winding 318 and the secondary winding 322, form a power transformer (i.e., power transformer 406 as described below with respect to FIG. 4). In some embodiments, the post mating surfaces 312 and 330 may mate flushly and be adhered together by an adhesive, such as epoxy, bonding, silicone adhesive, or the like. In other embodiments, the post mating surfaces 312 and 330 are recessed from the planes of the rim mating surfaces 338 and 331, respectively. In such embodiments, non-conductive foam or a similar material may be retained between the post mating surfaces 312 and 330 for maintaining a space between the posts 310 and 326 (i.e., an air gap within the transformer core). In some alternative embodiments, the air gap may be formed without the use of any material between the post mating surfaces 312 and 330 (i.e., the mating surfaces 312 and 330 are spaced apart).

The first pole piece 302 may be secured to the second pole piece 306 by a U-shaped clip 360 comprising flanges 362 for retaining the first pole piece 302 mated to the second pole piece 306. Additionally or alternatively, the first pole piece 302 may be secured to the second pole piece 306 by one or more other mechanical means, such as screws, bolts, bonding adhesives, snap features, clips, or the like. Although depicted as rectangular in shape, the first pole piece 302 and/or the second pole piece 306 may be of any shape comprising the aforementioned features.

In accordance with one or more embodiments of the present invention, the integrated sense transformer assembly 300 integrates a current sense transformer (i.e., a transformer formed by the center posts 352 and 382 along with the primary legs 317/319 and the secondary winding 346) with the power transformer (i.e., the transformer formed by the primary and secondary windings 318 and 322, respectively, and the power transformer core formed by the posts 310 and 326). The ½-turn winding of each primary leg 317 and 319 around opposing sides of the sense transformer bobbin 340 forms a single-turn winding such that current flowing through the primary winding 318 electromagnetically couples to the sense transformer secondary winding 346. The resulting current flow through the sense transformer secondary winding 346 may then be measured for determining a level of current flowing through the primary winding 318 of the power transformer.

Figure 4:
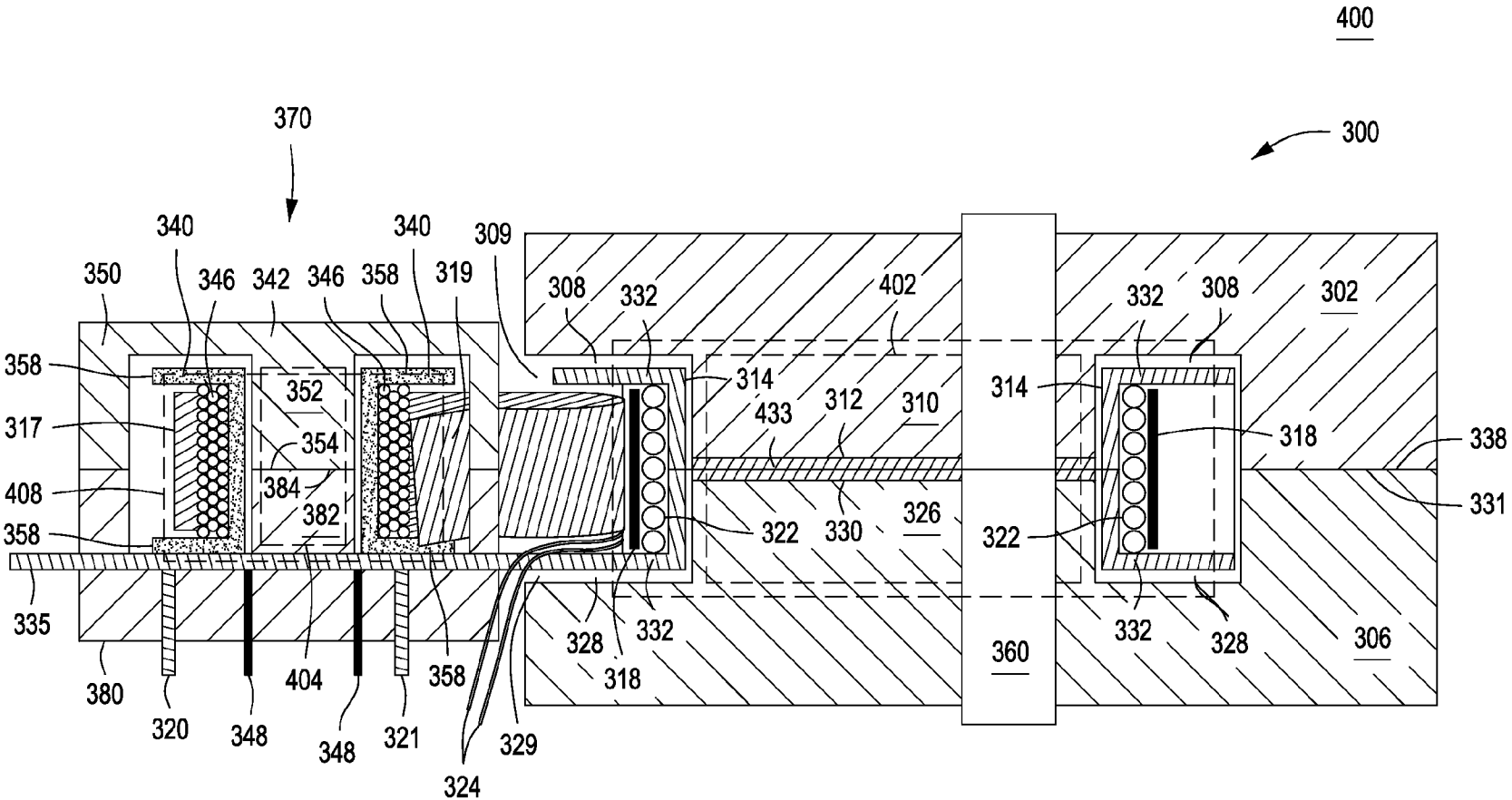
FIG. 4 is a cross-sectional view of an assembled integrated transformer assembly taken along line 4-4 of FIG. 3 in accordance with one or more embodiments of the present invention.

FIG. 4 is a cross-sectional view 400 of an assembled integrated transformer assembly 300 taken along line 4-4 of FIG. 3 in accordance with one or more embodiments of the present invention. The bobbin 314 is retained within the channels 308 and 328 over the first pole piece 302 and the second pole piece 306, respectively. The flanges 332 of the bobbin 314 define the winding area around the bobbin 314 within which the primary winding 318 and the secondary winding 322 are wound. As previously described with respect to FIG. 3, the primary winding 318 consists of "P" turns of a conductive foil, and the secondary winding 322 consists of "S" turns of a conductive wire (such as a copper wire). In one or more alternative embodiments, the primary winding 318 and/or the secondary winding 322 may consist of fewer or more turns and/or may be formed from a different conductive material. The secondary winding 322 terminates in secondary winding leads 324 extending through the sense transformer base 335.

The rim mating surface 338 mates flushly with the rim mating surface 331. In some embodiments, the rim mating surfaces 338 and 331 may be adhered to one another by an adhesive, such as a silicone adhesive or a similar epoxy. Non-conductive foam 433 (or a similar material) may be retained between the inner mating surfaces 312 and 330; for example, the foam 433 may be applied as a fluid between the inner mating surfaces 312 and 330 during assembly and subsequently cure into a hard material. In some alternative embodiments, an air gap between the inner mating surfaces 312 and 330 may be maintained without the use of any material (i.e., the mating surfaces 312 and 330 are spaced apart). In other alternative embodiments, the inner mating surfaces 312 and 330 may be mated flushly; in some such embodiments, the inner mating surfaces 312 and 330 may be adhered to one another by a silicone adhesive or a similar epoxy.

The posts 310 and 326 form a power transformer core 402 and along with the primary winding 318 and the secondary winding 322 form the power transformer 406 of the transformer assembly 300. In some embodiments, the power transformer 406 may be analogous to the transformer 204 described above.

The sense transformer base 335 and the primary legs 317 and 319 extend through a channel formed by the notches 309 and 329. The sense transformer bobbin 340 sits on the sense transformer base 335 and is retained between the mated frame members 350 and 380; in some embodiments, the frame member 350 may be secured to the sense transformer base 335, for example, by screws, bolts, adhesives, snap features, clips, or similar mechanical means. The mating surfaces 354 and 384 are mated flushly such that the center posts 352 and 382 form a sense transformer core 404 through the sense transformer bobbin opening 342. In some embodiments, the mating surfaces 354 and 384 may be adhered to one another, for example, by an adhesive. In some alternative embodiments, a material such as a non-conductive foam (or a similar material) may be retained between the mating surfaces 354 and 384 to provide an air gap within the sense transformer core 404; in other alternative embodiments, an air gap may be maintained between the mating surfaces 354 and 384 without the use of any material between the mating surfaces 354 and 384 (i.e., the mating surfaces 354 and 384 are spaced apart). The sense transformer core 404 along with the %-turn windings from the legs 317/319 and the sense transformer secondary winding 346 form the current sense transformer 408.

The flanges 358 of the sense transformer bobbin 340 define a winding area around the sense transformer bobbin 340 within which the sense transformer secondary winding 346 is wound. As previously described with respect to FIG. 3, the sense transformer secondary winding 346 is formed of a conductive wire, such as copper wire, and in some embodiments consists of a number of turns on the order of one-hundred. The sense transformer secondary winding 346 terminates in sense transformer secondary winding leads 348 extending through the sense transformer base 335.

Each of the primary legs 317 and 319 forms a ½-turn winding around opposing sides of the sense transformer bobbin 340, resulting in a single-turn winding around the sense transformer bobbin 340. The primary legs 317 and 319 pass through the sense transformer base 335 and terminate in primary winding leads 320 and 321, respectively.

The clip 360 retains the first pole piece 302 and the second pole piece 306 for ensuring that the first pole piece 302 and the second pole piece 306 remain securely mated.

Figure 5:
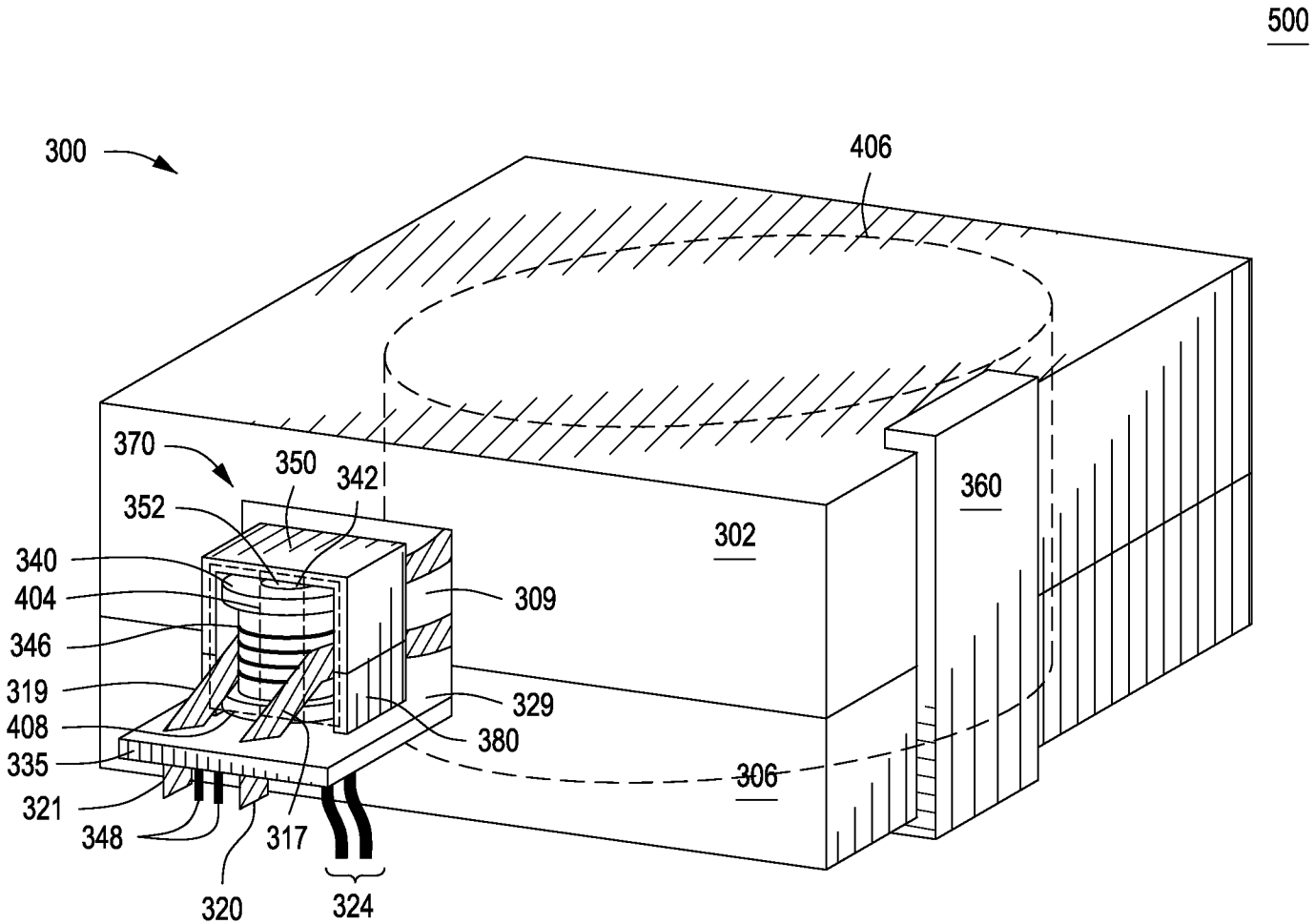
FIG. 5 is a perspective view of an assembled integrated transformer assembly in accordance with one or more embodiments of the present invention.

FIG. 5 is a perspective view 500 of an assembled integrated transformer assembly 300 in accordance with one or more embodiments of the present invention. The first pole piece 302 and the second pole piece 306 are mated flushly and secured by the clip 360. The sense transformer base 335 and the sense transformer assembly 370 extend through the notches 309/329 and horizontally away from the side of the mated first pole piece 302 and second pole piece 306. The sense transformer bobbin 340 is supported by the sense transformer base 335 and retained between the frame members 350/380 as previously described. The posts 352 and 382 extend into the sense transformer bobbin opening 342 to form the sense transformer core 404.

The sense transformer secondary winding 346 is wound around the sense transformer bobbin 340 and terminates in the sense transformer secondary leads 348 extending through the sense transformer base 335. The primary legs 317 and 319 extend through a channel formed by the notches 309/329 and each forms a ½-turn winding around opposing sides of the sense transformer bobbin 340, resulting in a single-turn winding around the entire sense transformer bobbin 340. The primary legs 317 and 319 pass through the sense transformer base 335 and terminate in primary winding leads 320 and 321, respectively. Additionally, the secondary winding leads 324 extend from the bobbin 314 within the mated pole pieces 302/306 and through the sense transformer base 335.

Figure 6:
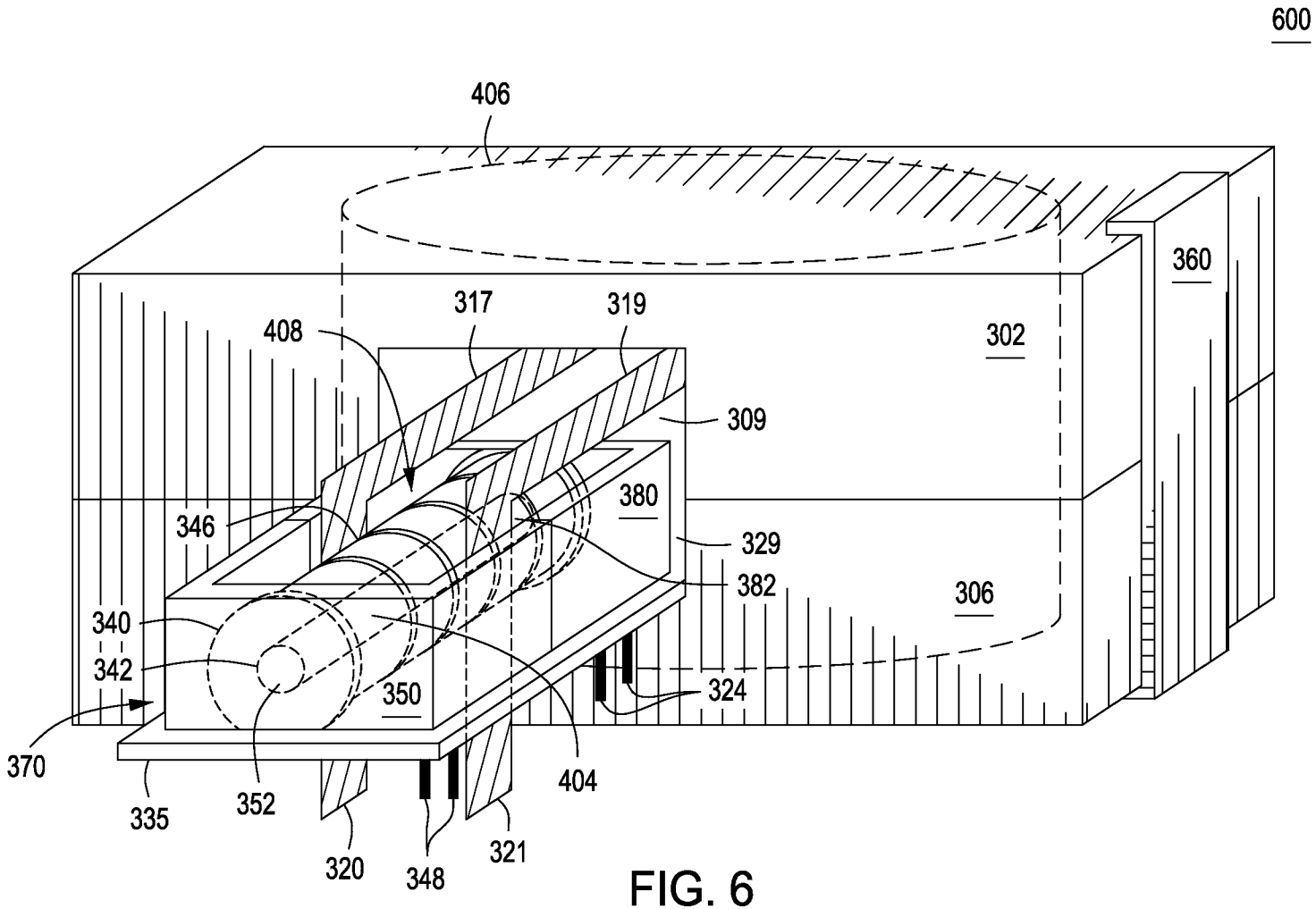
FIG. 6 is a perspective view of an assembled integrated transformer assembly in accordance with one or more alternative embodiments.

FIG. 6 is a perspective view of an assembled integrated transformer assembly 600 in accordance with one or more alternative embodiments. The integrated transformer assembly 600 comprises the same components and structure as the integrated transformer assembly 300 with the exception of the sense transformer assembly 370.

In the integrated transformer assembly 600, the first pole piece 302 and the second pole piece 306 are mated flushly and secured by the clip 360. The sense transformer base 335 extends horizontally through a channel formed by the notches 309 and 329 and away from the mated first pole piece 302 and second pole piece 306. The mated frame members 350/380 and the sense transformer bobbin 340 are oriented perpendicular to the side of the mated first pole piece 302 and second pole piece 306 (i.e., the bobbin 340 is coplanar with the sense transformer base 335). The mated frame members 350/380 are secured to the sense transformer base 335, for example, by screws, bolts, adhesives, snap features, clips, or similar mechanical means. The mated center posts 352/382 extend into the sense transformer bobbin opening 342 to form the sense transformer core 404.

The sense transformer secondary winding 346 is wound around the sense transformer bobbin 340 and terminates in the sense transformer secondary leads 348 extending through the sense transformer base 335. The primary legs 317 and 319 extend through the channel formed by the notches 309 and 320. Each of the primary legs 317 and 319 is bent at a 90° angle toward the sense transformer bobbin 340 and passes between the coupled frame members 350/380 and the sense transformer bobbin 340 to form a ½-turn winding around opposing sides of the sense transformer bobbin 340 (i.e., the primary legs 317 and 319 form a single winding turn around the entire sense transformer bobbin 340). The primary legs 317 and 319 pass through the sense transformer base 335 and terminate in primary winding leads 320 and 321, respectively. Additionally, the secondary winding leads 324 extend from the bobbin 314 within the mated pole pieces 302/306 and through the sense transformer base 335.

Figure 7:
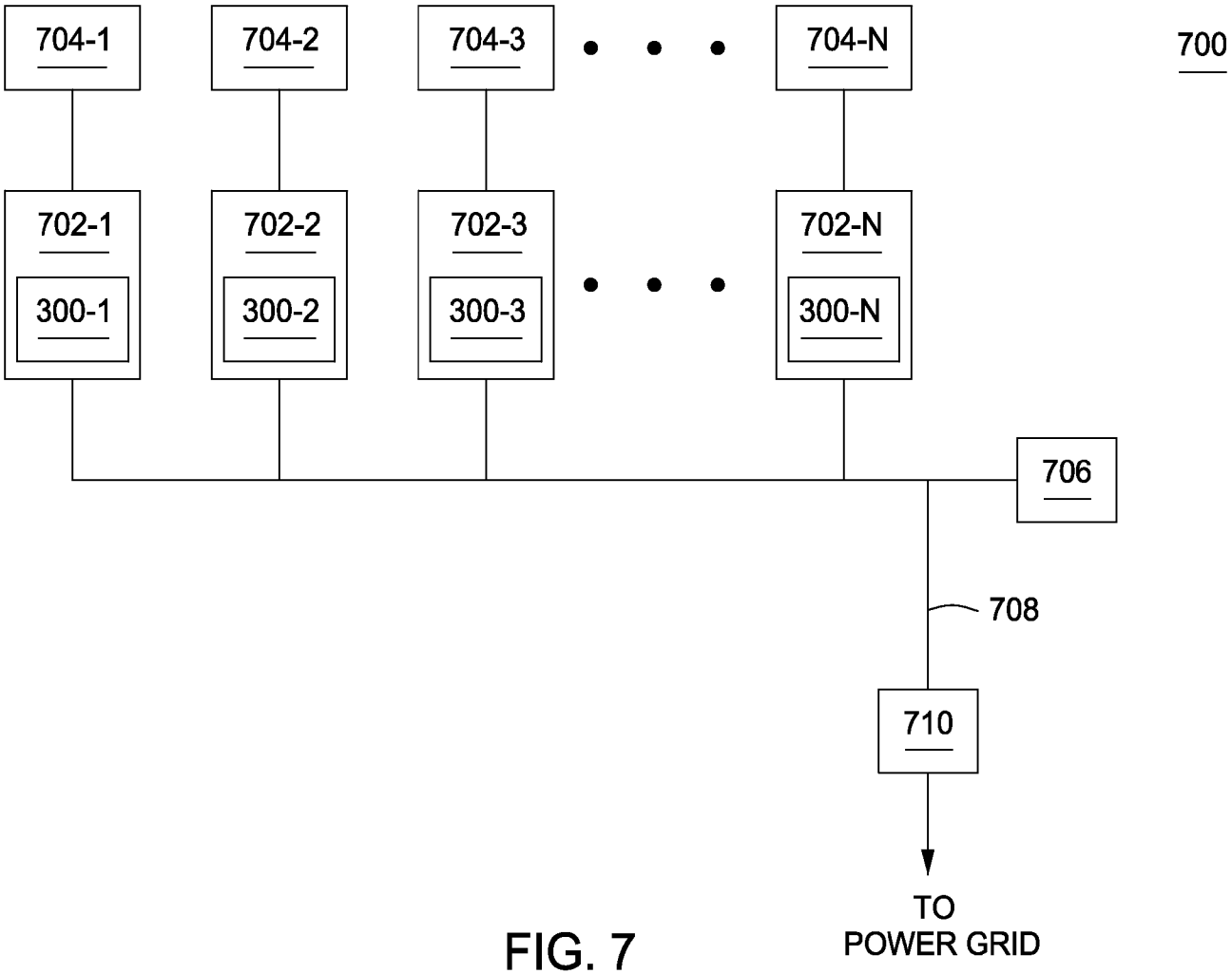
FIG. 7 is a block diagram of a system for inverting solar generated DC power to AC power using one or more embodiments of the present invention.

FIG. 7 is a block diagram of a system 700 for inverting solar generated DC power to AC power using one or more embodiments of the present invention. This diagram only portrays one variation of the myriad of possible system configurations and devices that may utilize the present invention. The present invention can be utilized in any system or device requiring a transformer and a means for measuring current level through the transformer, such as DC/DC converters, DC/AC converters, or the like. In some alternative embodiments, the system 700 may comprise DC/DC converters, rather than DC/AC inverters, for converting the received solar energy to DC power. In such embodiments, the DC/DC converters each comprise an integrated transformer assembly in accordance with the present invention.

The system 700 comprises a plurality of inverters 702-1, 702-2, 702-3 . . . 702-N, collectively referred to as inverters 702; a plurality of PV modules 704-1, 704-2, 704-3 . . . 704-N, collectively referred to as PV modules 704; a controller 706; an AC bus 708; and a load center 710.

Each inverter 702-1, 702-2, 702-3 . . . 702-N is coupled to a PV module 704-1, 704-2, 704-3 . . . 704-N, respectively. The inverters 702 are coupled to the controller 706 via the AC bus 708. The controller 706 is capable of communicating with the inverters 702 for providing operative control of the inverters 702. The inverters 702 are further coupled to the load center 710 via the AC bus 708.

The inverters 702 convert DC power generated by the PV modules 704 to AC power that is commercial power grid compliant and couple the AC power to the load center 710. The generated AC power may be further coupled from the load center 710 to the one or more appliances and/or to a commercial power grid. Additionally or alternatively, generated energy may be stored for later use; for example, the generated energy may be stored utilizing batteries, heated water, hydro pumping, $H_2O$-to-hydrogen conversion, or the like.

Each of the inverters 702 comprises an integrated transformer assembly 300 (i.e., the inverters 702-1, 702-2, 702-3 . . . 702-N comprise the integrated transformer assemblies 300-1, 300-2, 300-3 . . . 300-N, respectively) utilized in the conversion of the DC power to AC power. For example, the integrated transformer assembly 300 comprises a power transformer 406 and a current sense transformer 408, where the power transformer 406 may be utilized within a power conversion stage of the inverter 702 while the current sense transformer 408 measures current flowing through the power transformer in order to suitably control the power conversion. In some alternative embodiments, one or more of the inverters 702 may comprise an integrated transformer assembly 600 rather than the integrated transformer assembly 300. In other alternative embodiments, one or more of the inverters 702 may comprise a transformer, such as the transformer assembly 100, and a separate current sense transformer in lieu of the integrated transformer assembly 300.

In some embodiments, a DC/DC converter may be coupled between each PV module 704 and each inverter 702 (e.g., one converter per PV module 704). Alternatively, multiple PV modules 704 may be coupled to a single inverter 702 (i.e., a centralized inverter), and, in some such embodiments, a DC/DC converter may be coupled between the PV modules 704 and the centralized inverter.

Figure 8:
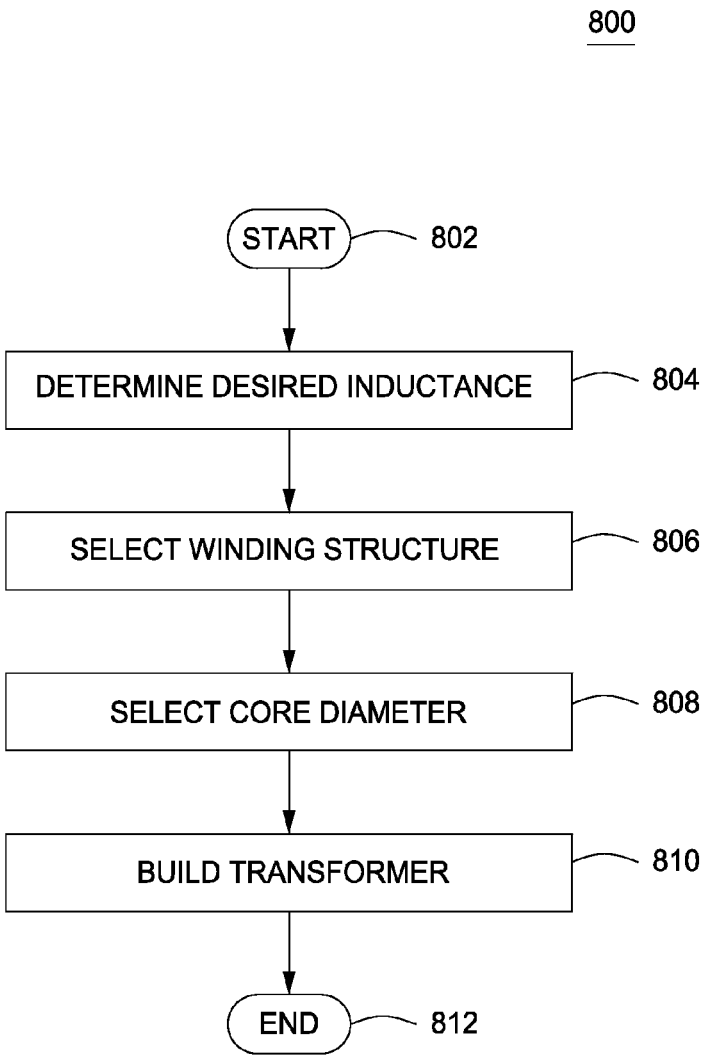
FIG. 8 is a flow diagram of a method for creating a transformer in accordance with one or more embodiments of the present invention.

FIG. 8 is a flow diagram of a method 800 for creating a transformer in accordance with one or more embodiments of the present invention. The method 800 may be utilized for designing and creating an efficient transformer that exhibits a low profile as well as low magnetic and copper losses, such as the transformer 204 or the transformer 406.

The method 800 starts at step 802 and proceeds to step 804. At step 804, a desired inductance is determined for the transformer. The method 800 proceeds to step 806 where a winding structure is selected. A number of turns of a primary winding is selected (e.g., one or two turns), as well as a corresponding number of turns of a secondary winding. In some embodiments, the primary winding may be selected to be one turn of a conductive foil (such as an insulated, laminated foil) and the secondary winding may be selected to be seven turns of an insulated copper wire. In other embodiments, the primary winding may be selected to be two turns of the conductive foil, for example, employed in an interleaved design, and the secondary winding may be selected to be fourteen turns of the insulated copper wire. The primary and secondary windings may be wound around an annular bobbin, such as the bobbin 114 or the bobbin 314.

The method 800 proceeds to step 808. At step 808, a core diameter for a magnetic core of the transformer is selected. The core diameter is selected such that a desired inductance may be efficiently achieved when having one or two turns of the primary winding; in some embodiments, an inductance of 3.6 microhenries may be achieved for a primary winding having one turn, a secondary winding having seven turns, and a core cross-sectional area of 6 $cm^2$. The transformer core diameter is selected such that the desired inductance is achieved with the core loss comparable to the winding loss; in some embodiments, the transformer core diameter may be selected to be on the order of 20 mm. Such a configuration results in a small winding area as compared to the core cross-section and thus a transformer that exhibits a low profile as well as low magnetic and copper losses. In one embodiment, the transformer may be designed to process 225 W at 99% efficiency (i.e., 2.25 W loss) with a profile less than 15 mm.

The method 800 proceeds to step 810, where the transformer is built per the selected parameters. The method 800 then proceeds to step 812 where it ends.

The foregoing description of embodiments of the invention comprises a number of elements, devices, circuits and/or assemblies that perform various functions as described. These elements, devices, circuits, and/or assemblies are exemplary implementations of means for performing their respectively described functions.

While the foregoing is directed to embodiments of the present invention, other and further embodiments of the invention may be devised without departing from the basic scope thereof, and the scope thereof is determined by the claims that follow.

The invention claimed:

1. An integrated transformer assembly, comprising:

a sense transformer, comprising:

a sense transformer magnetic core having a center post; and a sense transformer secondary winding wound around the center post of the sense transformer magnetic core, wherein the sense transformer secondary winding comprises a plurality of turns of a second conductive material; and a power transformer, physically and electromagnetically coupled to the sense transformer, comprising:

a power transformer magnetic core;

a power transformer primary winding wound around the power transformer magnetic core, wherein the power transformer primary winding comprises one or two turns of a first conductive material; and a power transformer secondary winding wound around the power transformer magnetic core; wherein a first end of the power transformer primary winding and a second end of the power transformer primary winding are disposed along opposing sides of the center post of the sense transformer magnetic core to form a sense transformer primary winding;

and wherein the first end and the second end are opposite ends of the power transformer primary winding.

2. The integrated transformer assembly of claim 1, wherein the first and the second ends form a single turn of the sense transformer primary winding.

3. The integrated transformer assembly of claim 2, wherein the first and the second ends each form one-half of a winding turn on opposing sides of the center post of the sense transformer magnetic core to form the single turn of the sense transformer primary winding.

4. The integrated transformer assembly of claim 1, further comprising a power transformer bobbin, wherein (i) the power transformer magnetic core is disposed within an opening of the power transformer bobbin, (ii) the power transformer primary winding and the power transformer secondary winding are wound around the power transformer bobbin, and (iii) a flange of the power transformer bobbin extends as a base for supporting the sense transformer.

5. The integrated transformer assembly of claim 4, wherein the power transformer magnetic core is formed from a first pole piece and a second pole piece mated to form mated first and second pole pieces, wherein the power transformer bobbin is retained within the mated first and second pole pieces.

6. The integrated transformer assembly of claim 5, wherein the first and the second pole pieces comprise a first and a second pole, respectively, and wherein the first and the second poles form the power transformer magnetic core.

7. The integrated transformer assembly of claim 6, wherein the first and the second poles are spaced apart to maintain an air gap.

8. The integrated transformer assembly of claim 5, wherein the base extends through the mated first and second pole pieces and is disposed external to the mated first and second pole pieces.

9. The integrated transformer assembly of claim 4, wherein the sense transformer magnetic core is formed from first and second frame members, at least one of the first or the second frame member substantially E-shaped, and a bobbin of the sense transformer is retained between the first and the second frame members.

10. The integrated transformer assembly of claim 9, wherein the first and the second frame members are mated, and wherein the first end of the power transformer primary winding passes through a first opening in the mated first and second frame members and the second end of the power transformer primary winding passes through a second opening in the mated first and second frame members.

11. The integrated transformer assembly of claim 9, wherein the first and the second frame members are mated through the base.

12. The integrated transformer assembly of claim 1, wherein the plurality of turns of the second conductive material is on an order of one hundred and the power transformer secondary winding comprises seven turns.

13. The integrated transformer assembly of claim 2, wherein the first conductive material is a laminated foil and the second conductive material is an insulated copper wire.

14. The integrated transformer assembly of claim 4, wherein the sense transformer is capable of being retained proximately perpendicular or proximately parallel to the base.

* * * * *